United States Patent [19]

Gordon

[11] 3,957,175

[45] May 18, 1976

[54] NEWSPAPER VENDING MACHINE

[75] Inventor: Roger G. Gordon, Richmond, Calif.

[73] Assignee: Safe Rack, Inc., San Leandro, Calif.

[22] Filed: Aug. 22, 1974

[21] Appl. No.: 499,476

Related U.S. Application Data

[63] Continuation-in-part of Ser. No. 361,791, May 18, 1973, abandoned.

[52] U.S. Cl. ..... 221/215; 221/250; 221/267

[51] Int. Cl.² ..... G07F 11/16

[58] Field of Search ..... 221/247, 248, 250, 267, 221/270, 274, 303, 306, 307, 308, 210, 213, 220, 214–216; 312/35, 294, 295; 49/142, 143

[56] References Cited

UNITED STATES PATENTS

| | | | |
|---|---|---|---|
| 839,304 | 12/1906 | Long | 221/270 |
| 1,273,437 | 7/1918 | Wilmore | 221/213 |
| 1,528,778 | 3/1925 | Millar et al. | 221/115 |
| 1,591,774 | 7/1926 | Payzant | 221/310 |
| 2,195,305 | 3/1940 | Heaton | 221/213 |
| 2,263,040 | 11/1941 | Kaltenbach | 221/250 |
| 2,819,819 | 1/1958 | Warren | 221/250 |

FOREIGN PATENTS OR APPLICATIONS

| | | | |
|---|---|---|---|
| 5,348 | 3/1905 | United Kingdom | 194/80 |

*Primary Examiner*—Robert B. Reeves
*Assistant Examiner*—H. Grant Skaggs
*Attorney, Agent, or Firm*—Robert G. Slick

[57] ABSTRACT

A newspaper vending machine is provided which is coin operated and which discharges a single paper on each operation of the coin mechanism, preventing theft of papers.

5 Claims, 21 Drawing Figures

NEWSPAPER VENDING MACHINE

REFERENCE TO RELATED APPLICATION

This application is a continuation-in-part of my application Ser. No. 361,791 filed May 18, 1973, now abandoned.

SUMMARY OF THE INVENTION

Newspaper vending machines have been long used but they have suffered from a number of defects. Some of the machines work purely on the honor system so that there is no necessity for putting a coin in a box when a paper is taken. However, the vast majority of newspaper vending machines which are coin operated provide for opening the entire supply of newspapers when the coin mechanism is actuated on the assumption that a customer will ordinarily take only one paper. Frequently, a customer will take more than one paper and also may not properly reclose the vending machine so that the next customer will find the door ajar and can take a paper without paying for it.

In accordance with the present invention, a simple vending machine is provided which is substantially foolproof in that on each activation of the coin mechanism, only a single paper will be discharged and the remainder of the papers will be retained in the machine.

The present invention also provides a machine which is easily loaded since it is not necessary to make any special preparation of the newspapers except to put them in the machine.

The device of the present invention also provides an adjustment so that newspapers of varying thicknesses can be accommodated.

Other features and advantages of the machine will be apparent from the balance of the specification.

DESCRIPTION OF THE PREFERRED EMBODIMENT

Figure 1:
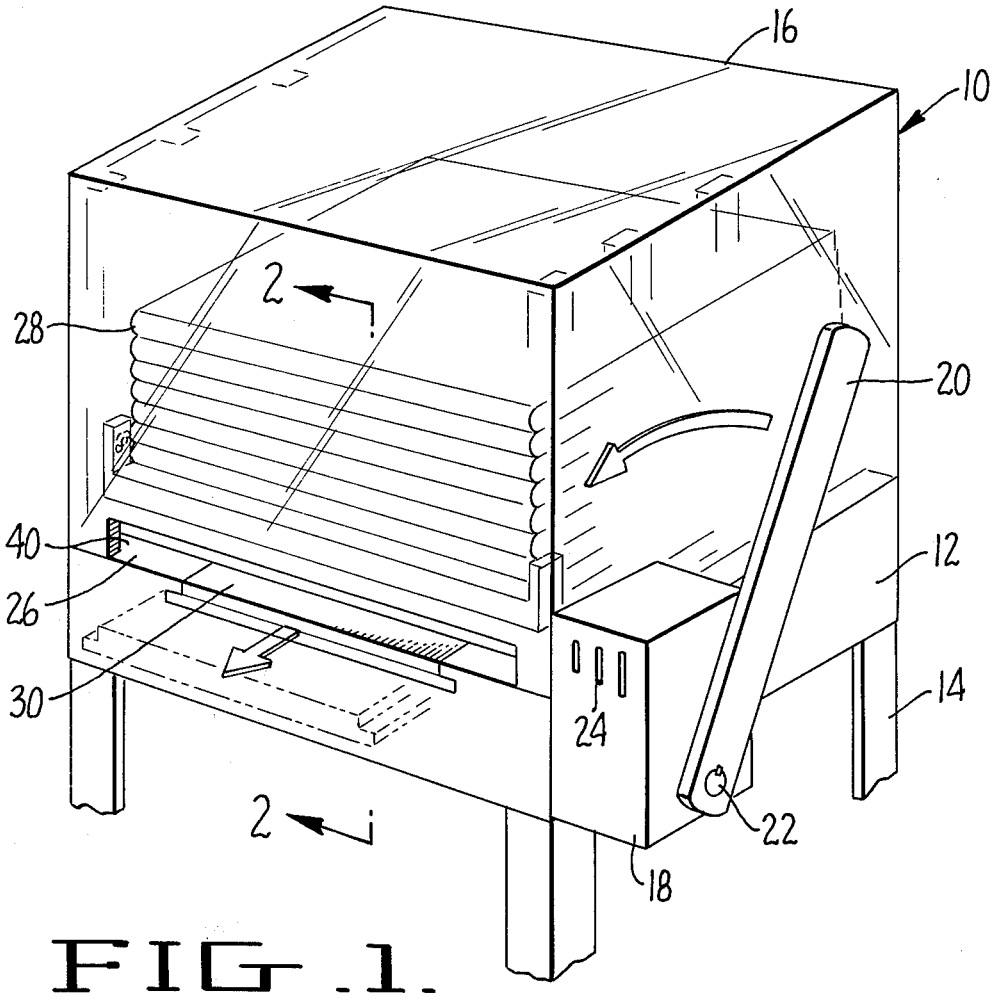
FIG. 1 is a perspective view of a device embodying the present invention.

Referring now to the drawings by reference characters, the vending machine is generally designated 10 and it has a base 12 supported by suitable legs 14. Supported by the base 12 is a cover 16 which is preferably made of a transparent material or at least with a transparent top so that a customer can see that there is a supply of newspapers in the machine and that the newspapers are of the latest date. Mounted on one side of the machine is a coin box 18 having a lever 20 thereon which actuates shaft 22. The coin box 18 has the usual slots 24 for the insertion of coins and the coin mechanism will not be described since such devices are well known to those skilled in the art. Suffice it to say that when the proper combination of coins has been placed in the slots 24, shaft 22 will be released so that the lever arm 20 can be actuated by pulling if forward and upon its release, it will return to its retracted position and become locked until another set of coins has been placed in the mechanism.

Figure 2:
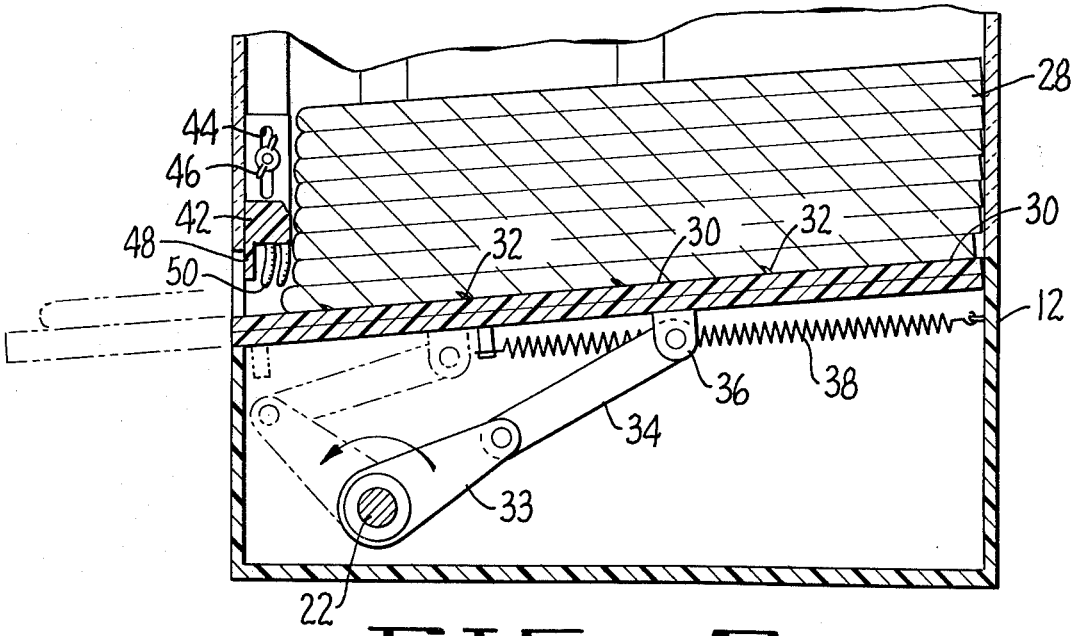
FIG. 2 is a section on the line 2—2 of FIG. 1.

The newspaper vending machine has a bottom 26 on which a stack of newspapers 28 can be placed. In the center of the bottom 26 there is a cutout with a slider 30 mounted thereon. Slider 30 carries a series of sharp pointed members 32 which will later be described in detail. Shaft 22 carries a crank arm 33 which is connected by means of linkage 34 to a bracket 36 which is attached to slider 30. A spring 38 is connected between the bracket 36 and the base 12 of the machine so that normally slider 30 is held in a retracted position, but when shaft 22 is released and lever 20 is actuated, slider 30 will move forward as is shown in dot/dash lines in FIGS. 1 and 2. Upon release of the arm 20, spring 38 will retract the slider and the coin mechanism will again lock shaft 22.

Figure 3:
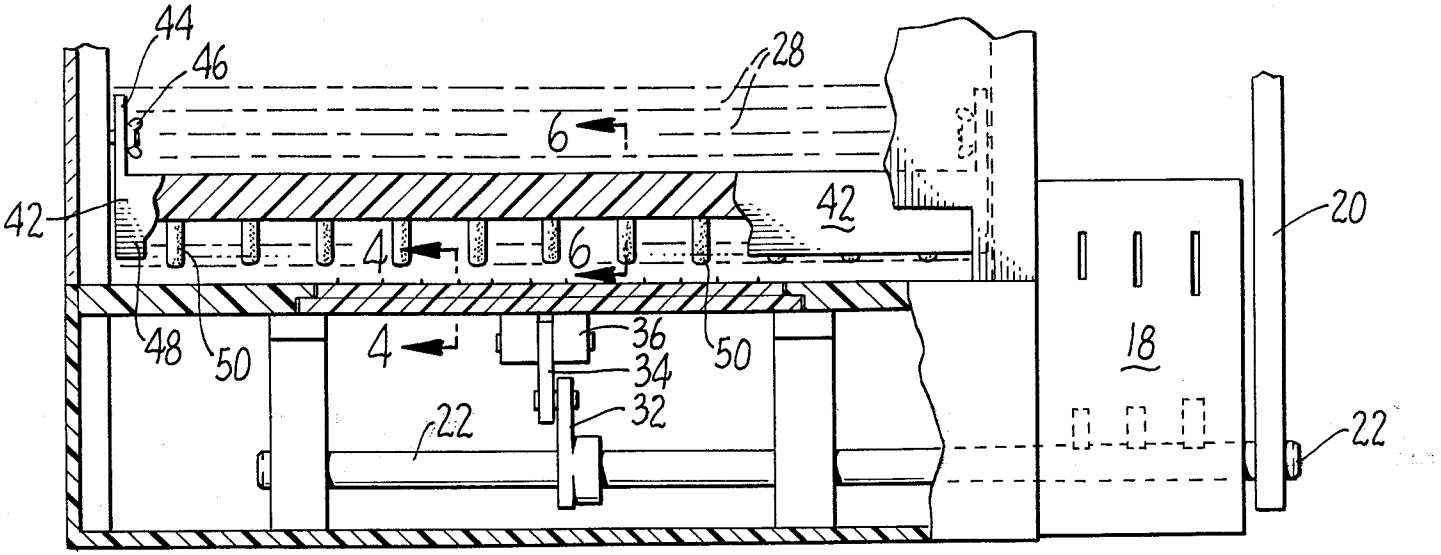
FIG. 3 is an enlarged view, partly in section, of the front of the machine.
Figure 6:
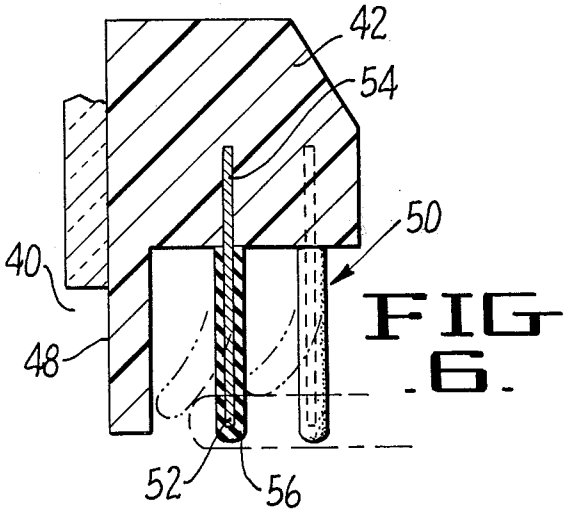
FIG. 6 is an enlarged section on the line 6—6 of FIG. 3.

Directly over bottom 26 and slider 30 is a slot 40 which is the width of a newspaper. Mounted over the slot 40 is a bar 42 which preferably can be moved up and down by means of a slotted bracket 44 carried on the bar and thumb screws 46. It will be understood, of course, that the slot 40 is normally made to have a sufficient height to allow the thickest newspaper to pass therethrough while the bar 42 is adjusted to accommodate the thickness of a newspaper to be dispensed on that particular day. If newspapers of uniform thickness are to be dispensed, the bar can be fixed rather than adjustable. The bar 42 has a front lip 48 and mounted behind the lip are the flexible fingers, generally designated 50. Preferably there are two rows of fingers, as is shown in FIG. 6, and they extend across the width of the machine at intervals, as is shown in FIG. 3. Preferably, the flexible fingers consist of a central fairly stiff wire 52 which has a rubber or plastic coating 56 thereon. The fingers are anchored into the members 42 as at 54. It will be noted that the flexible fingers 50 extend slightly below lip 48. These flexible fingers are essential to prevent more than one paper to be dispensed at a time. They are pushed out of the way to permit discharge of a single paper but swing into the lip 48 to prevent passage of a second paper as is shown in FIG. 6.

Figure 5:
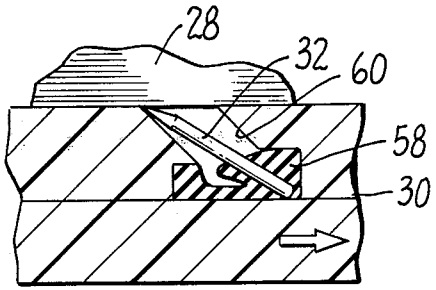
FIG. 5 is an enlarged view, similar to FIG. 4, showing the discharge mechanism in its retracted position.
Figure 4:
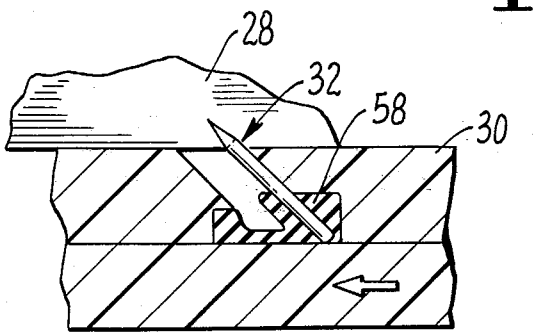
FIG. 4 is a section on the line 4—4 of FIG. 3.

It was previously that the pointed members 32 were used to push papers forward and it is necessary that these pointed members not tear or pull the paper during the return stroke and two methods of accomplishing this are shown in FIGS. 4 and 5 and in 7 and 8.

Referring now to FIGS. 4 and 5, the sharpened members 32 point forward at an angle of about 45° and are embedded in a soft material such as soft rubber 58 in the slider 30. The pointed members 32 are normally held in a 45° upright position against a shoulder 60 formed in the slider. As is shown in FIG. 4, as the slider moves forward, the points extend above the slider and will engage and push out a newspaper 28. When the slider now retracts, as is shown in FIG. 5, the flexible mounting 58 permits the points to bend down so that they merely slide over the next adjacent newspaper 28.

Figure 7:
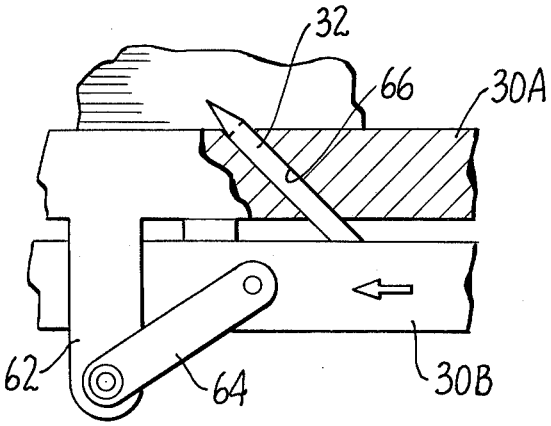
FIG. 7 is an enlarged view of an alternate discharge mechanism.
Figure 8:
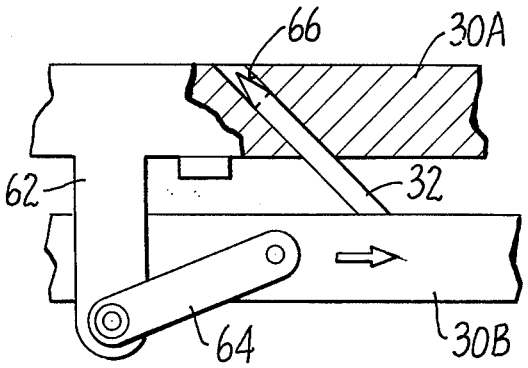
FIG. 8 is a view of the mechanism shown in FIG. 7 in the retracted position.

Another method of providing this same action is shown in FIG. 7. Here, instead of a single solid slider, the slider is formed in two parts, namely an upper part 30A and a lower part 30B. An arm 62 extends downwardly from 30A and the bottom of the arm is fastened by means of a link 64 to the bottom slider member 30B. The points 32 are mounted solidly in the bottom member 30B and pass upwardly through holes 66 in member 30A which are inclined at an angle of about 45°. Movement is applied from the lever through the lower member 30B and, as can be seen in FIG. 7, as the arm 30B moves forward, pointed member 32 will be thrust up through the hole 66 and into a paper. However, as member 30B is moved to the rear, as shown in FIG. 8, member 32 will move downwardly as well as to the rear so that the pointed member 32 will not lie below the surface of the slider member 30A and little drag will be exerted on the papers.

Figure 9:
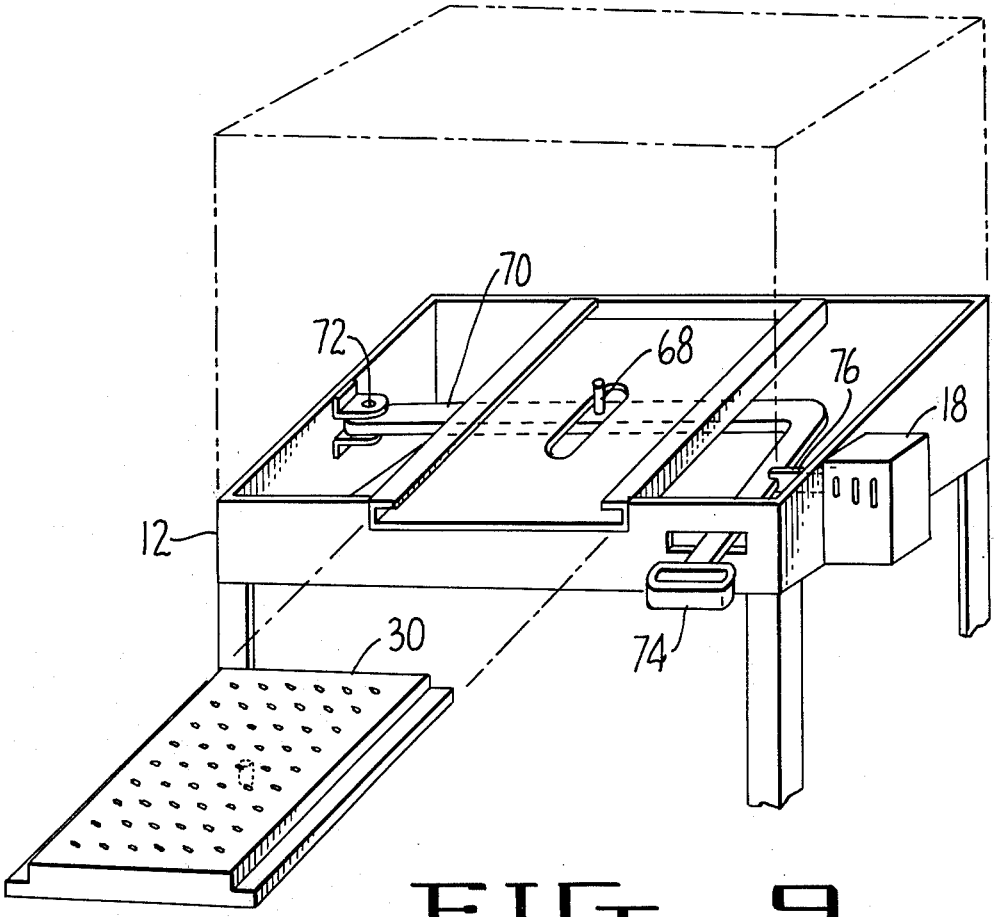
FIG. 9 is a partial view of an alternate form of the discharge mechanism.

Another form of discharge mechanism is shown schematically in FIG. 9, although the general principle of operation is exactly the same as has been previously described. Here, the slider 30 is actuated by a pin 68 mounted on a lever arm 70. Lever arm 70 is pivoted at 72 to one side of the frame 12 of the machine and the opposite end of this arm is bent to a right angle and brought out to the front of the machine and terminates in a handle 74. A coin box 18 is used as before this type of coin box has arm 76 which is capable of engaging and disengaging the lever arm 70. After the proper number of coins have been placed in the box, arm 76 releases arm 70 and one then pulls the handle 74 to discharge a single paper.

Figure 10:
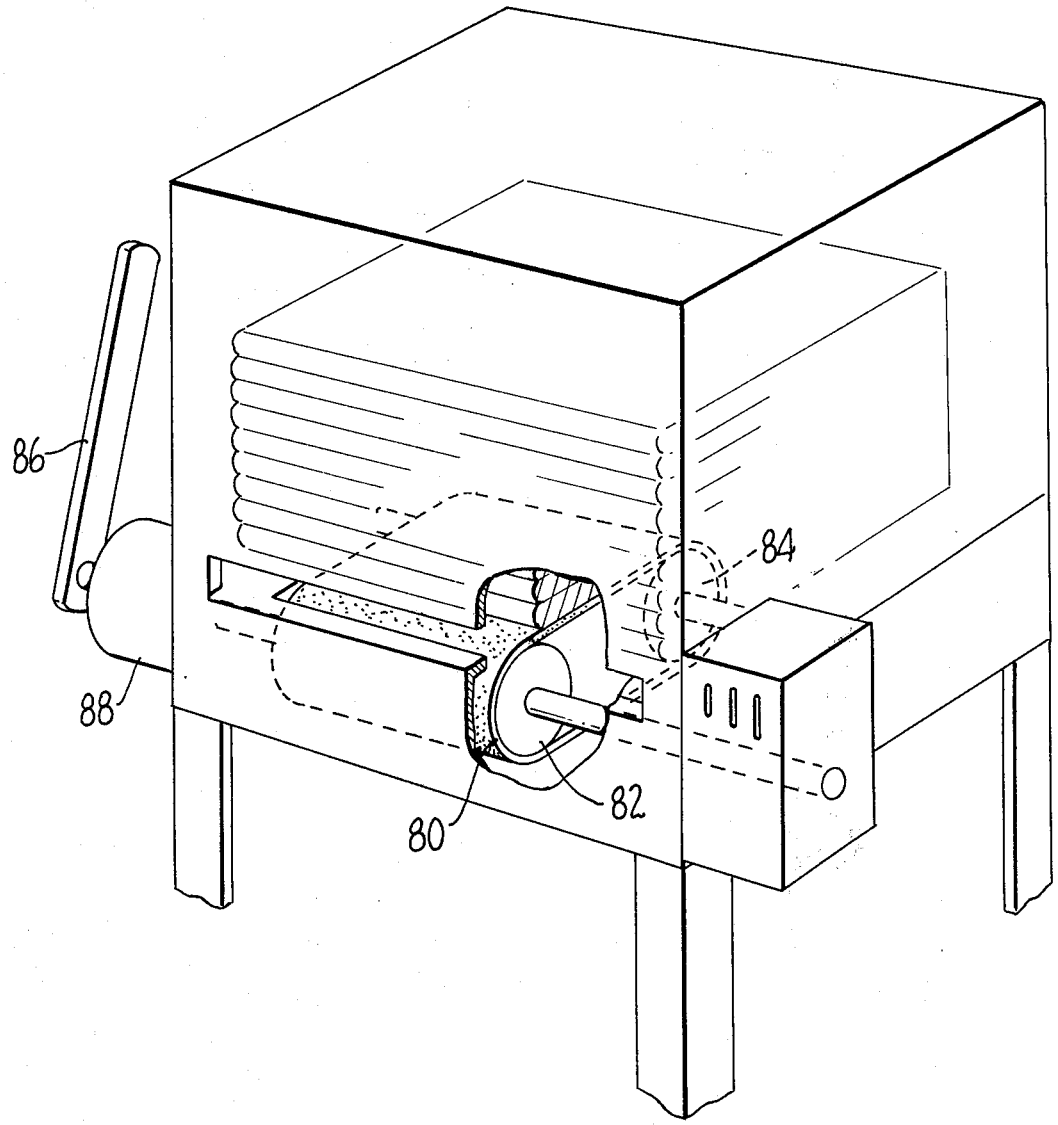
FIG. 10 is a perspective view of another alternate form of discharge mechanism.
Figure 11:
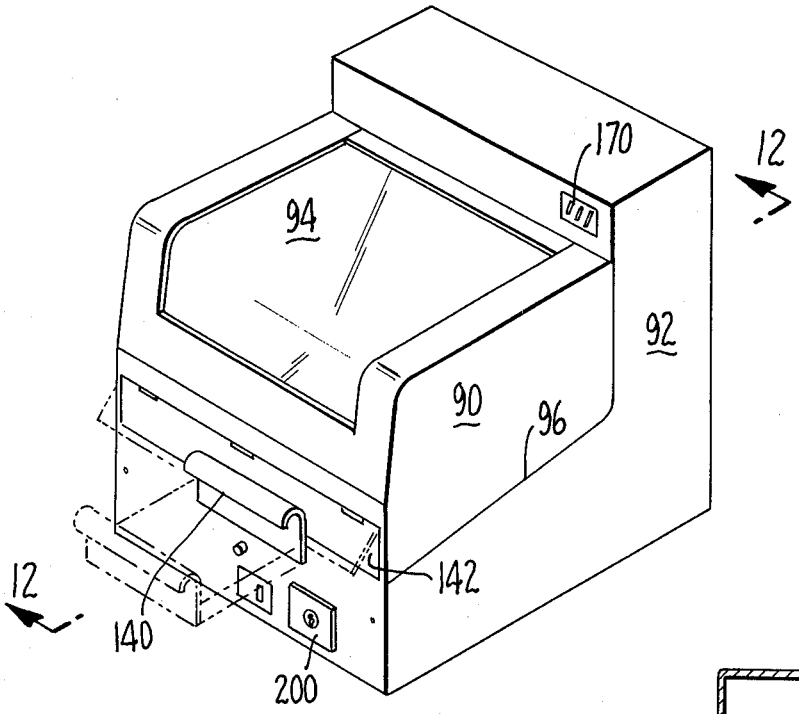
FIG. 11 is a perspective view of another embodiment of my invention.

Still another form of discharge mechanism is shown schematically in FIG. 10, but here again the general principle of operation is exactly the same as has been previously described. Here an endless belt of rubber or similar material is held on the rollers 82 and 84. Upon insertion of the proper coins in the box, the roller 82 is released so that the lever 86 can be brought forward to discharge a paper. A one-way clutch 88 is provided having a spring return mechanism so that after a paper is discharged, arm 86 will return to its normal position upon release.

Reference is now specifically made to the improved embodiment of my machine shown in FIGS. 11 thru 21. In this version of the device, a removable cover 90 is provided on a machine having a basic framework 92, the cover, preferably having a transparent opening 94. The top 90 rests on the framework 92 with the upper edge of frame 92 engaged on a lower edge of the top as at 96. The rear portion of the top has an upturned ledge 98 adapted to engage a downturned ledge 100 of the framework while the front part of the top if provided with locking means, generally designated 102, which will hereinafter be described in more detail. By releasing the locking means at 102, one can pull out and up on the front of the cover 90, completely releasing it from the framework, making it easy to load the machine and to adjust the machine for the accommodation of papers of various sizes.

The paper supporting mechanism within the device consists of the two inverted U-shaped members 104 and 106 which are spaced from each other so that their outside extremities represent a little more than the width of a standard newspaper. Each of the members has ridges 108 thereon so that the papers will glide easily over the surface. Each of the U-shaped members has an inward downturned lip 110 and 112, and each of these downturned lips has at least two L-shaped slots therein, generally designated 114. Each of the slots has a long horizontal portion 116 which is parallel to the glides 108 and a shorter, downturned rear section 118.

Figure 13:
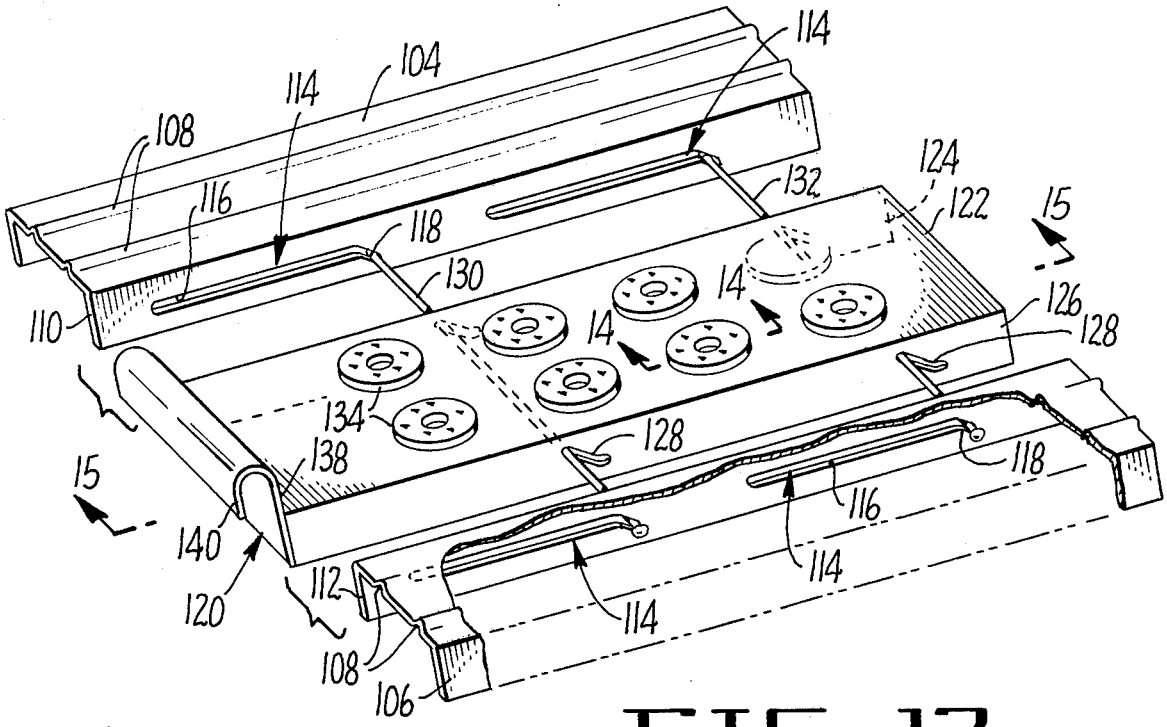
FIG. 13 is an exploded perspective view of a newspaper supporting and pushing mechanism.
Figure 14:
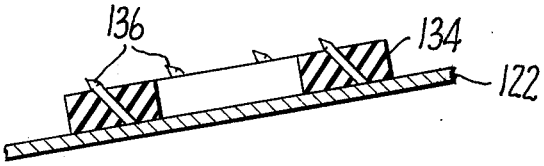
FIG. 14 is an enlarged section on the line 14—14 of FIG. 13.
Figure 18:
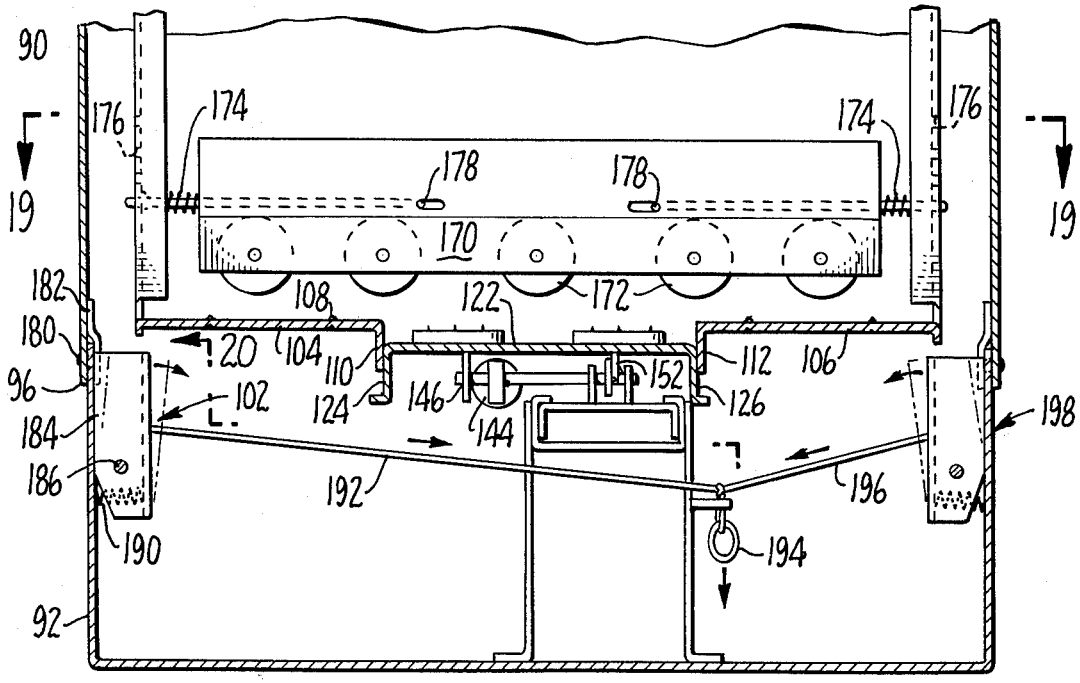
FIG. 18 is a section on the line 18—18 of FIG. 12.
Figure 20:
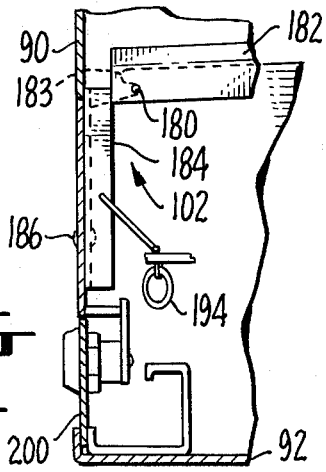
FIG. 20 is a section on the line 20—20 of FIG. 18.

The paper propelling mechanism is generally designated 120 and consists of a slider 122 having downturned edges 124 and 126. The downturned edges form a sliding fit between the downturned edges 110 and 112 as is best seen in FIG. 18. In FIG. 13 the parts are shown spaced to better illustrate the action. The downturned edges 124 and 126 of slide 122 have slots 128 which slant upwardly and to the front at an angle of roughtly 45°. Rods 130 and 132 pass through the slots on the slider into the corresponding slots on the side members 104 and 106. The slider is provider with a number of resilient pads 134, preferably of synthetic rubber. A series of pointed members 136 extend from the pads and point toward the front of the machine at an angle of roughly 45°. The front of the slider is provided with an upturned lip 138 having a curved finger grip 140.

Figure 12:
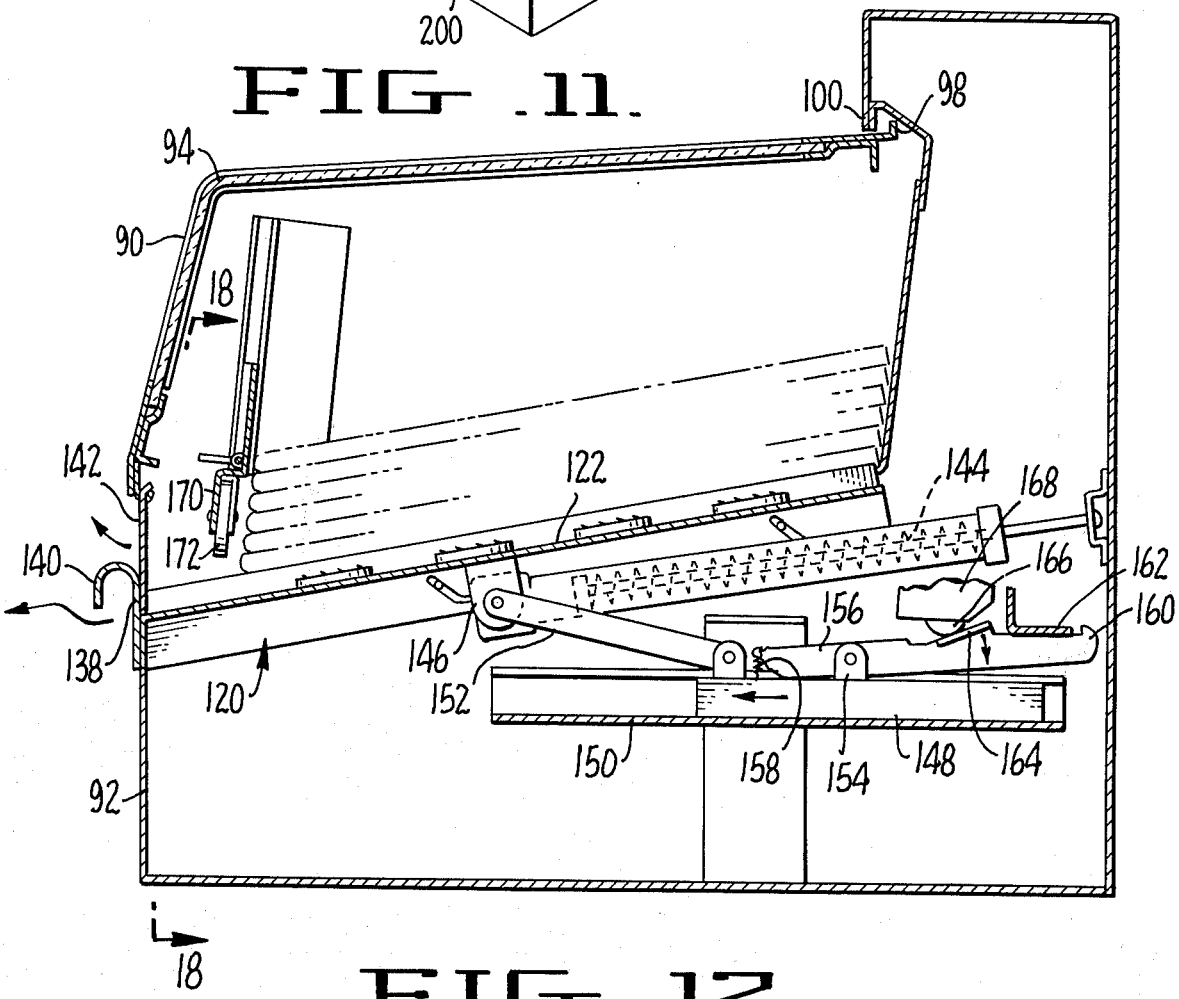
FIG. 12 is a section on the line 12—12 of FIG. 11.

A hinged door 142 is provided at the front of the machine and the door extends the full width of the machine and is somewhat higher than the thickness of the largest newspaper which one expects to dispense. When the slide is in its retracted position, lip 138 holds the door closed as is best seen in FIG. 12 and permits it to open as the slide moves forward.

The paper supporting members 104 and 108 are fastened to the frame of the machine, while the sliding member is held suspended between these members by the rods 130 and 132 as previously described. The slide is normally maintained in a retracted position by means of a spring 144 which is attached to a bracket 146 depends from the slide. A second sliding member 148 which can slide back and forth in guides 150 and is attached to the slide 122 by means of an arm 152. Slide 148 has an upwardly extending bracket 154 on which lever arm 156 is pivoted. Arm 156 is normally biased in a counter-clockwise direction by means of spring 158 so that a catch 160 on the rear of the arm engages a bracket 162 fastened to the frame of the machine. Arm 156 also carries a cam 164 which is adapted to be engaged by a coin 166 held in chute 168. The coin actuating mechanism used is not part of the present invention but suffice it to say that when a coin or the proper combination of coins is inserted in a coin mechanism 170, arm 156 is rotated slightly clockwise, which frees the catch 160 from the bracket 162 so that the slide is released. One can now pull on finger grip 140 and pull the slide forward, freeing door 142 to permit the slide to go forward and deliver a paper.

Figure 15:
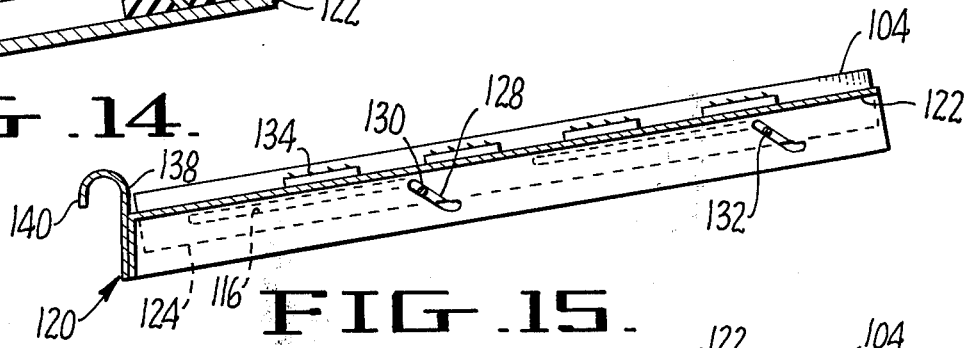
FIG. 15 is a section on the line 15—15 of FIG. 13.
Figure 16:
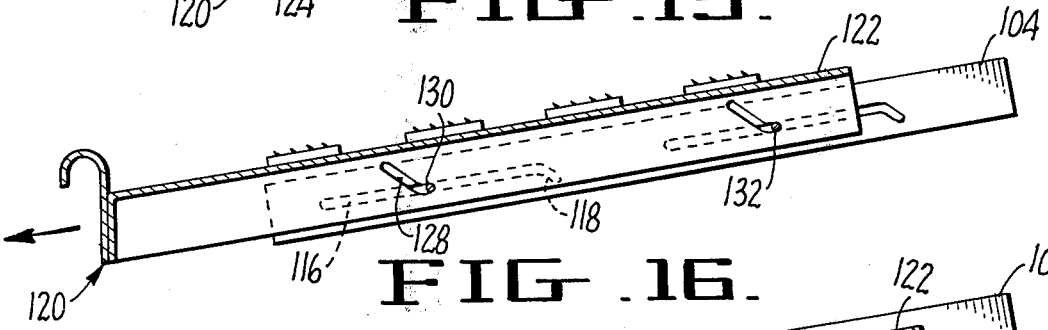
FIG. 16 is a section, similar to FIG. 15, showing the position of the parts when the slide is being moved forward.
Figure 17:
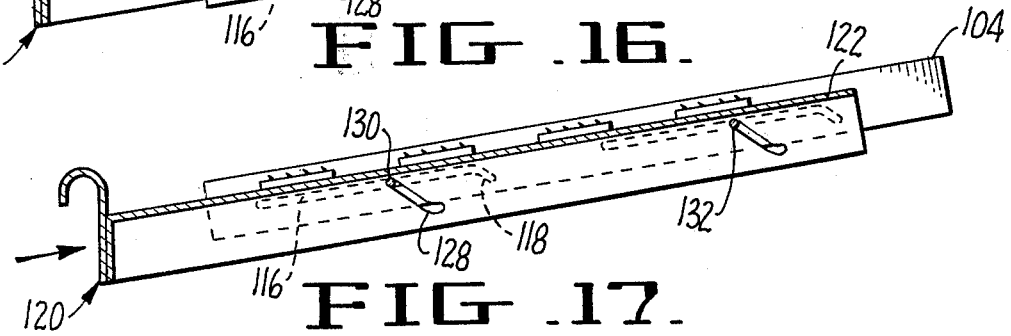
FIG. 17 is a similar view showing the position of the parts when the slide is being moved backwards.
Figure 19:
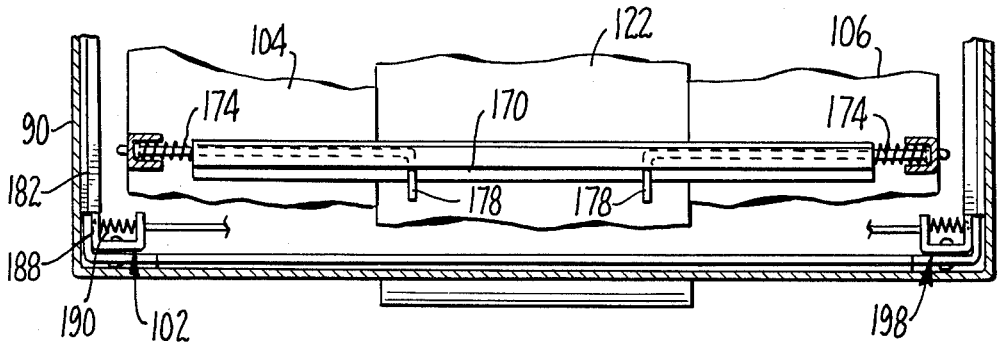
FIG. 19 is a section on the line 19—19 of FIG. 18.

The action of the slide can best be seen by referring to FIGS. 15, 16 and 17. When the slide is pulled forward, the first action, as is shown in FIG. 15, is for the slide to ride-up through the grooves 128 and simultaneously move up through the grooves 118 so that the points 136 engage on the bottom of the lowest paper in the stack to propel it forward. When the slide 122 has risen to its highest position, it moves forward in the horizontal slots 116 propelling the paper out of the machine so that it can be grasped and removed. Now, as one releases the grip 140 the slide is first lowered slightly by the action of the grooves 128 and spring 144 pulls the slide backward with the rods 130 and 132 passing along the horizontal portion of slot 116 until it gets to the rear whereupon the rod now goes down into the short L-shaped section 118, fully lowering the slide. Thus, the points 136 are completely out of engagement with the next paper as the slide moves to its retracted position.

To prevent more than one paper from being dispensed by the machine at a time, a bar 170 extends across the front of the stack of papers. Bar 170 carries a series of discs 172 and it has been found that these discs constitute a most effective method of preventing more than one paper from being dispensed at a time. Bar 170 is supported on the rods 174 which extend into slots 176 on each side of the framework. Rods 174 have extensions mounted at right angles thereto at 178. Thus, by pushing inwardly on the members 178, bar 170 can be positioned at a desired height to accommodate papers of various thicknesses.

Figure 21:
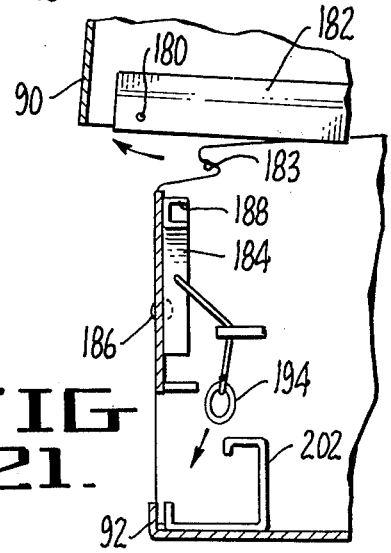
FIG. 21 is a view similar to FIG. 20 but showing the parts in an unlocked condition.

It was previously mentioned that the cover 90 was engaged at the rear of the machine by the interlocking members 98 and 100, and that the front of the machine by the mechanism generally designated 102. This mechanism will now be described in detail. Cover 90 has pins 180 held in brackets 182. Pins 180 secure cover 90 to base 92 when in slots 183. Arm 184 pivoted at point 186 and has a lip 188 at the top thereof. Compression spring 190 normally holds the lip in engagement with the front edge of bracket 182. A flexible member 192 leads from the arm 184 to ring 194 while a similar flexible member 196 leads to the companion locking mechanism, generally designated 198, on the opposite side of the machine. A locked door 200 provides access to the ring 194 as is shown in FIG. 21. This door may also give access to a coin box 202 if desired. To load the machine it is only necessary to unlock the door 200 and reach in and pull ring 94. This releases the latches at the front of the machine so that cover 90 can be lifted off. Unsold papers can be removed from the machine and a new supply of papers placed into the machine. If necessary, one can also adjust the position of bar 170. The cover is replaced and the device is ready for operation.

Many variations can be made in the exact structure shown without departing from the scope of this invention.

I claim:

1. A newspaper dispensing machine having in combination:

a. a container for a plurality of horizontally disposed newspaper stored in a vertical stack, said container having a front wall with a horizontally disposed newspaper dispensing slot defined therein, b. a dispensing mechanism mounted under said stack of newspapers, said dispensing mechanism including an inclined slide for supporting newspapers thereon, said slide having a leading edge and means for moving said slide from a first position directly under said stack of newspapers, to a second position displaced horizontally toward said front wall with said slide leading edge located outside of said container so that a newspaper supported on said slide is moved through said slot into a dispensing location, said slide carrying a series of pointed members for contacting a newspaper and dispensing same, said pointed members extending upwardly and forwardly at an angle of about 45° to said slide, c. cam means for raising said pointed members as said slide advances from the first position to the second position, said cam means retracting said pointed members as said slide moves from the second position to the first position, said cam means including a plurality of resilient mountings fixed to said slide with said pointed members being connected to said resilient mountings so that as said slide moves forwardly, the resilient mountings cause the points of said pointed members to be oriented to extend above said slide to engage a newspaper for dispensing same and as said slide moves rearwardly, said resilient mountings move to permit said pointed members to move into an inactive position wherein said pointed members merely slide on a newspaper, d. said slot having a top wall and being located near the bottom of said front wall, e. a movable bar mounted on said front wall adjacent said slot top wall and having a lip which extends downwardly so that the lower end thereof is located beneath said top wall, f. a plurality of flexible downwardly extending finger-like members mounted in a plurality of spaced apart rows on said movable bar at positions located behind said front wall and above said slot, said rows of members each being spaced from said front wall, said members extending downwardly to a position slightly below said lip lower end and spaced from said slide a distance slightly less than a newspaper thickness so that said members are pushed toward said front wall by a newspaper being moved on said slide and flex to permit the passage of said newspaper thereunder, said member extending beneath said lip a sufficient distance so that the bottom newspaper of said stack is permitted to move out through said slot while a second newspaper stacked on top of said bottom newspaper is contacted and held a predetermined distance away from said slot and is prevented from reaching said slot.

2. The structure of claim 1 wherein said slide includes an upper member and a lower member, said upper member having a series of holes therethrough at an angle of about 45° pointed toward the front wall of the machine and said lower member carries a series of pointed members extended upwardly into said holes and means for bringing said upper and lower members together as said slide advances towards said slot whereby on said advance said pointed members protrude through said holes and on the return stroke, said upper and lower members are separated whereby said pointed members are retracted.

3. A newspaper dispensing machine having in combination:

a. container for a plurality of newspaper stacked horizontally, said container having a front wall, b. a dispensing mechanism mounted under said stack of newspapers, said dispensing mechanism including a slide with means for moving said slide from a first position directly under said stack of newspapers, to a second position displaced horizontally toward said front wall, said slide carrying a series of pointed members extending upwardly and forwardly at an angle of about 45° to said slide, c. cam means for raising said pointed members as said slide advances from the first position to the second position, said cam means retracting said pointed members as said slide moves from the second position to the first position, d. a slot in said front wall of said vending machine near the bottom thereof, said slot being approximately the thickness of a single newspaper.

e. a plurality of downwardly extending members mounted behind said front wall and over said slot, said members being spaced from said front wall and from the bottom of said stack of newspapers whereby said members will permit the bottom newspaper of said stack to move out through said slot but will prevent a second newspaper from being pushed through said slot, f. said slide including a forward upwardly turned lip extending outside of the dispensing machine and the slot in the front wall of the said dispensing machine has a hinged door thereon, said hinge being at the top thereof, said upturned lip normally holding said door shut when the slide is in the first position and permitting said door to swing open when said lip is moved away from said door.

4. The structure of claim 3 having a pair of fixed supporting members adjacent to each edge of the stack of newspaper to support said newspapers and having said slide mounted between said side members, and a movable mounting means for said slide for raising said slide above said fixed members when said slide moves from the first position to the second position and moving said slide below the level of said fixed members when said slide moves from the second position to the first position and means for moving said mounting means.

5. The structure of claim 4 wherein said fixed members have downward inturned lips, each having a plurality of L-shaped slots therein, said L-shaped slots having a long horizontal section and a short section at the rear thereof sloping downwardly at an angle of about 45° and said slide has mating slots extending downwardly at an angle of about 45° and said structure includes rods passing through the slots of the fixed members and the slide whereby as said slide moves from the first position to the second position, said rod will rise up in said slots causing said slide to rise during a forward stroke and to retract during a rearward stroke.

* * * * *